United States Patent [19]

Gregory

[11] 4,047,649

[45] Sept. 13, 1977

[54] APPARATUS FOR HANDLING HOSIERY

[75] Inventor: Clifton Gregory, Hickory, N.C.

[73] Assignee: Marvel Specialty Company, Hickory, N.C.

[21] Appl. No.: 656,901

[22] Filed: Feb. 10, 1976

[51] Int. Cl.[2] ..... A41H 43/00

[52] U.S. Cl. ..... 223/43; 53/21 FW; 302/2 R; 223/39

[58] Field of Search ..... 223/75, 43, 60, 42, 223/39–41, 112; 53/21 FW; 112/121.15; 302/2 R, 4; 221/175, 178, 180, 182, 191, 289

[56] References Cited

U.S. PATENT DOCUMENTS

| | | | |
|---|---|---|---|
| 2,722,348 | 11/1955 | Ammon | 223/43 |
| 2,898,022 | 8/1959 | Miles et al. | 223/75 |
| 2,957,613 | 10/1960 | Autem | 223/43 |
| 3,532,258 | 10/1970 | Kieuel | 223/43 |
| 3,606,477 | 9/1971 | Sorensen | 302/2 R |
| 3,704,565 | 12/1972 | Glaze | 223/75 X |
| 3,908,874 | 9/1975 | Nichol et al. | 223/75 |

*Primary Examiner*—G. V. Larkin

*Attorney, Agent, or Firm*—Lowe, King, Price & Markva

[57] ABSTRACT

In a hosiery handling apparatus wherein a string of hosiery is placed on a movable hollow tubular form, and everted through the open end of the form, a reciprocating arm grasps the first in-line hose and breaks it away from the string. The arm then pulls the hose across the top of a horizontal platform to a predetermined, fixed location on the platform. During the pulling operation, frictional resistance (drag) between the hose and platform tends to straighten the hose. An upstanding guide member, formed on the platform, prevents the hose from moving laterally off the platform. After the hose is located on the platform, the platform is tilted downwardly to dump the hose into a neat stack in a tray located beneath the platform. This readies the hose for a subsequent seaming operation.

14 Claims, 3 Drawing Figures

Fig. 1
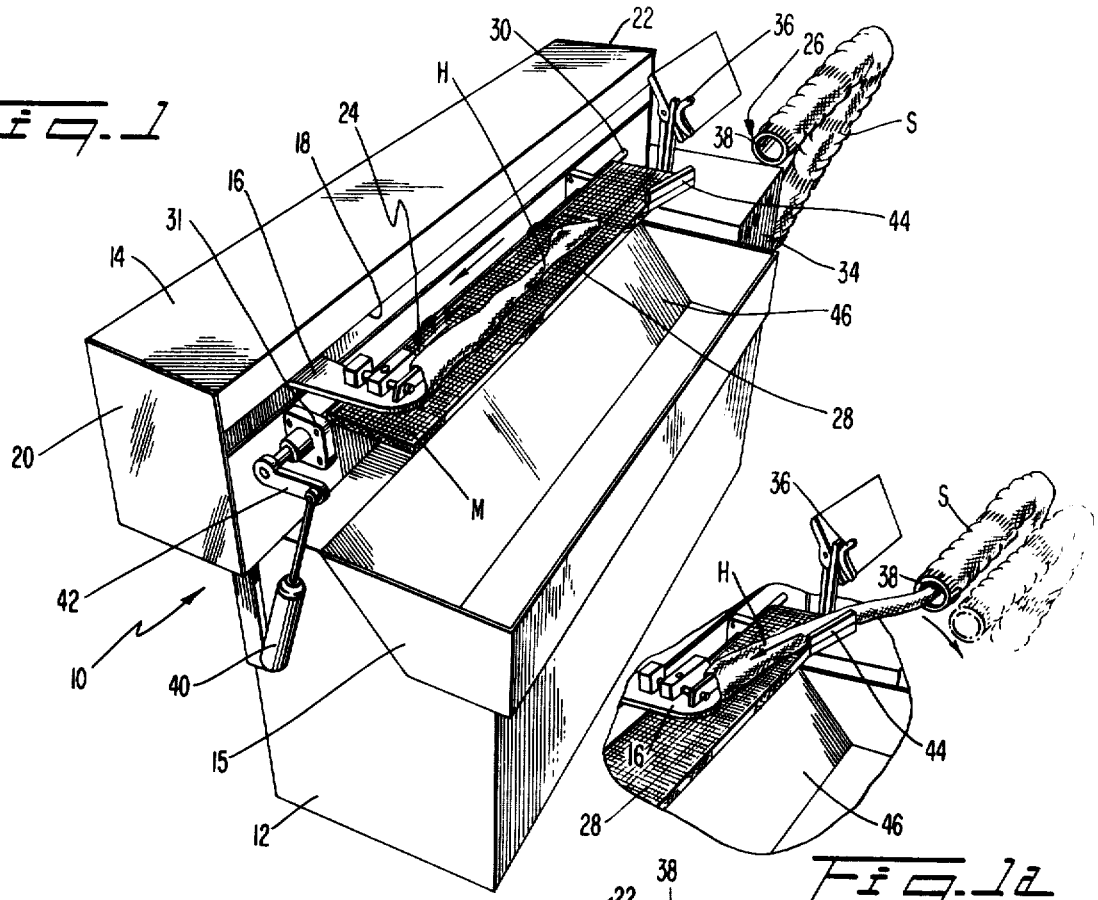
Fig. 1a
Fig. 2
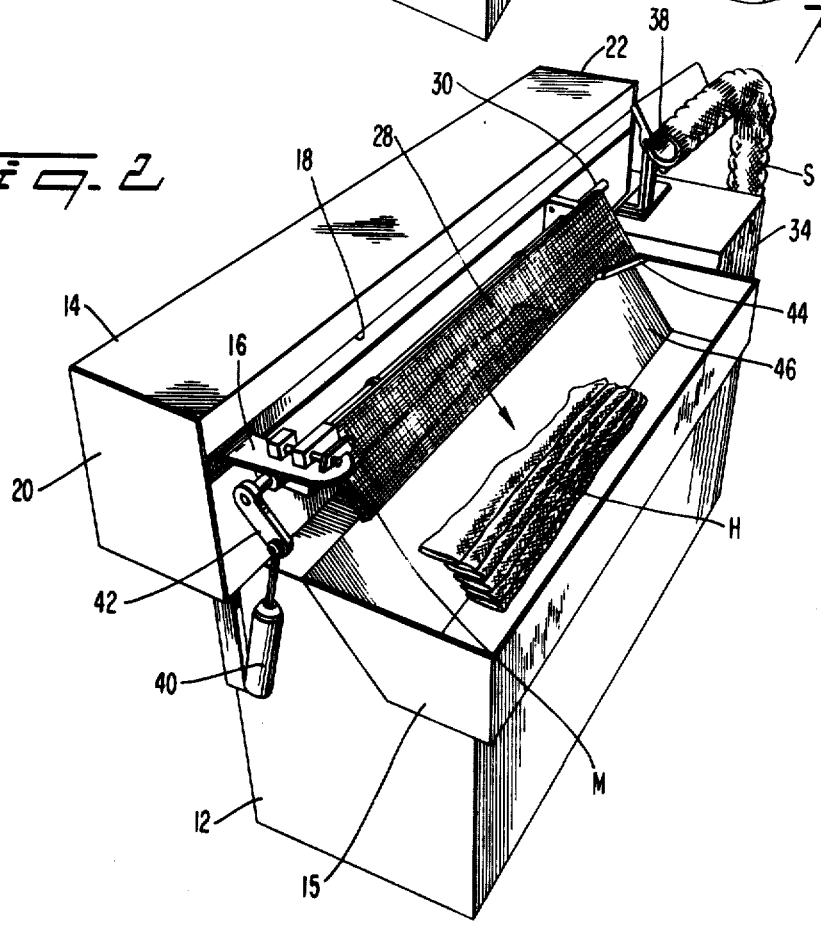

APPARATUS FOR HANDLING HOSIERY

BACKGROUND OF THE INVENTION

The present invention relates generally to handling of hosiery during the manufacturing process, and more particularly, to an apparatus for straightening and stacking individual hose after they are turned and separated from the string.

During the manufacture of hosiery, particularly socks, it is common practice to knit the hosiery in a continuous, elongated tube divided by longitudinally-spaced, knitted rings of break-away thread. The first in-line hose is everted, or turned inside-out, and then broken away from the string by pulling. The hose is thus ready for closing the toe by the seamstress.

An apparatus for expediting the everting and separating steps is disclosed in U.S. Pat. Nos. 3,887,120 and copending application Ser. No. 527,441, filed Nov. 26, 1974, now U.S. Pat. No. 3,949,913 both assigned to the assignee of the present invention. In both U.S. Pat. Nos. 3,887,120 and 3,949,913, with a hollow tubular form located in a first working position, the hosiery string is loaded onto the form. An egress of air out the open end of the form assists in this operation by opening the string and reducing frictional resistance. The form is then pivoted to a second working position, wherein the first in-line hose on the string is everted into the open end of the form. An ingress of air at the open end of the form assists in that operation by drawing in the hose. Finally, the form is pivoted to a third working position to initiate a separating and stacking cycle of operation. A pair of fingers carried on a reciprocating arm come together and grasps the double-over end portion of the hose, and snaps it from the string at the ring of break-away threads. The arm then advances the hose along a predetermined path to a stacking region. Our U.S. Pat. No. 3,949,913 includes an improvement feature No., wherein the hosiery form is U-shaped to conserve floor space.

In the seaming operation that follows stacking, the operator ties a stack of about 24 hose, and transfers the stack to another station for sewing the toe. The seaming operation requires that the individual hose be stacked as evenly as possible. Thus, the operator must even up the individual hose before the stack is tied. Because the additional step of "evening up" must be performed, uneveness in the stack that results using prior apparatus substantially slows down the manufacturing operation.

OBJECTS OF THE INVENTION

It is thus an object of this invention to provide an improved apparatus for more efficiently manufacturing hosiery.

Another object is to provide an improved apparatus for stacking turned and separated hosiery during the manufacturing process.

A further object is to provide an improved apparatus that more evenly stacks individual hose that have been separated from a hosiery string.

A still further object of the invention is to provide an improved apparatus for straightening individual hose separated from a hosiery string, and then evenly stacking the hose in a tray for subsequent seaming.

Another object is to provide a stacking apparatus, wherein individual hose separated from a hosiery string are pulled along a platform for straightening before the hose are stacked.

It is another object of the invention to provide an improved apparatus for straightening and stacking hose separated from a hosiery string, wherein the hose are pulled along a platform for straightening before they are stacked, and wherein a guide member is provided to prevent the hose from laterally slipping off the platform.

Another object of this invention is to provide an improved apparatus for stacking hosiery, wherein a large number of hose are stacked.

BRIEF DESCRIPTION OF THE INVENTION

Briefly, in accordance with the invention, an apparatus for stacking hose separated from a hosiery string disposed on a tubular form comprises a pair of gripping fingers on a reciprocating arm for grasping and separating hose from the string by an initial pull, and then pulling the hose across a horizontal platform. During pulling, frictional resistance between the platform and hose causes the tail end of the hose to drag behind, and this tends to straighten the hose. After the hose has been advanced to a predetermined, fixed position on the platform, the fingers release and the platform is tilted to dump the hose into a tray located beneath the platform. The hose slides from the tilted platform along a beveled sidewall of the tray into a neat stack, ready for seaming.

The tubular form for storing the hosiery string is pivotable among first, second and third positions. In the first position, the hosiery is loaded onto the form, and an egress of air from the open end of the form is provided to open the string and reduce frictional resistance. In the second position, an ingress of air at the open end is provided to draw in the first in-line hose for eversion. Finally, in the third position, a separating and stacking cycle is initiated.

In the separating and stacking cycle, a reciprocating arm having a pair of fingers for gripping the hose is advanced from its rest position to the tubular form. The set of fingers grasps the doubled-over end portion of the first in-line hose at the mouth of the form. The arm then returns toward its rest position. As the initial return movement occurs, the hose is snapped from the hosiery string at the ring of break-away threads, and then the hose is dragged along the upper surface of the platform for straightening. The upper surface of the platform contains a layer of fabric material, such as denim, having a high coefficient of resistance with the hosiery. The added frictional resistance improves the straightening of the hose as it is pulled along the platform.

An upstanding guide member is attached to the side of the platform adjacent the hosiery form. The guide prevents the operator from laterally moving the hose off the platform by inadvertently returning the form back to its second position before the hose has been properly located on the platform.

The platform is mounted on a hinge for selectively positioning the platform (1) substantially horizontally for straightening the hose, and (2) inclined downwardly for dumping the hose into the tray. The platform is pivoted about the hinge with a pneumatic cylinder connected between the base of the apparatus and the platform. The cylinder is operated in response to the position of the tubular form; the platform is tilted downwardly as the advancing step is completed and the form is moved to the third position to initiate a new separating and stacking cycle.

Still other objects and advantages of the present invention will become readily apparent to those skilled in the art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 1 is a perspective view of a preferred embodiment of the invention, illustrating the platform and stacking tray, and with a hose located in position on the tray for stacking;

FIG. 1A is a more detailed view of the platform showing the operation of the upstanding guide member; and FIG. 2 is a perspective view of the apparatus shown in FIG. 1, with the platform tilted downwardly for stacking hose.

DETAILED DESCRIPTION OF THE PREFERRED EMBODIMENT

Referring now to FIGS. 1 and 2 of the drawings, there is shown a preferred embodiment of an apparatus for separating, straightening, and stacking hose in accordance with the principles of the present invention. Specifically, the apparatus, generally designated by the reference numeral 10, includes a base 12 upon which are mounted a drive unit 14 for operating a reciprocating arm 16, and a tray 15. The arm 16 is movable within channel 18 between the opposite ends 20 and 22 of the drive member 14. Arm 16 contains a pair of fingers 24 that come together and close for gripping a folded over end of a hose H for initially pulling the hose from hosiery string S on tubular form 26, and secondly, advancing the hose along the upper surface of a horizontal platform 28 for straightening. The outermost gripping finger of the pair is formed by an elongated plate carried on the end of an actuating rod. A base plate is fixedly carried on the arm 16 and forms the other gripping finger. One end of the base plate slidably supports the actuating rod, which may be the armature of a solenoid (see FIGS. 1, 1*a* and 2). Platform 28 is pivotally mounted on a shaft 30 supported by members 31 (only one is shown), and is orientatable selectively in a substantially horizontal position (FIG. 1) and a downwardly tilted position (FIG. 2). As will be described in more detail below, a hose H, separated by being pulled initially from the hosiery string S, is advanced by arm 16 to a predetermined, fixed location on platform 28. The frictional resistance of "drag" between the hose and platform straightens the hose as it is advanced. Then, as the arm 16 disengages hose H and begins the return toward the form 26 for engaging another hose, platform 28 is tilted downwardly to the position shown in FIG. 2, dumping the hose into tray 15 (the angle of the downward tilt of platform 28 must, of course, be large enough to overcome the coefficient of static friction between the hose and platform). Since each of the hose is positioned at precisely the same location on platform 28 before dumping, the hose are neatly stacked in vertical alignment to each other in the tray 15.

Referring now to FIG. 1 in more detail, tubular form 26 is of a type disclosed in U.S. Pat. No. 3,949,913, supra. As described therein, the tubular form 26 is U-shaped, and extends outwardly from base 34, up and around toward platform 28, as shown. Hosiery string S, placed on the form 26, is a continuous tube of knitted material made up of a plurality of individual hose or socks connected together by rings of break-away thread such as alginate yarn.

Form 26 is manually movable to be positionable selectively in first, second and third positions (the first and third positions are shown respectively in FIGS. 1 and 2). The form is manually pivoted between the operative positions by the operator. In the first position (FIG. 1), form 26 is pivoted away from stop 36. In this position, the hosiery string S is manually loaded onto the form 26, while an egress of air is provided out the open end or mouth 38 of the form to help open the string and reduce frictional resistance, as described in U.S. patent 3,949,913. In the second position (intermediate the positions shown in FIGS. 1 and 2), ingress of air (suction) is provided in the open end 38 of the form 26 for eversion, or turning in, of the first in-line hose on the string S, also as described in U.S. Pat. No. 3,949,913 (see FIG. 3). The operator assists by manually advancing the string S toward the open end on the form 26 and folding and stopping the first in-line hose edge around the open end 38. The ingress of air draws the hose into open end 38 of the form 26 thereby everting or turning the hose. Finally, in the third position (FIG. 2), arm 16 is ready for a cycle of separating, straightening, and stacking the hose.

Movement of arm 16 is controlled by limit switches (not shown) responsive to the position of form 26. With form 26 located in its third position, as shown in FIG. 2, arm 16 is advanced by any suitable mechanism along channel 18 toward the tubular form 26 until fingers 24 engage the exposed rim of the first in-line hose on string S. As shown in FIG. 1, the hose is engaged along the welt between the fingers. It is clear that the outermost finger on the arm 16 enters the open end 38 of the form 26 with the other finger formed by the base plate remaining on the outside. The properly timed solenoid activation draws the fingers together grasping the hose. After fingers 24 have engaged the hose H, the direction of movement of arm 16 is automatically reversed. Hose H is thus snapped off string S by the initial pulling action and then pulled toward end 20 of drive unit 14 (see FIG. 1). As hose H is advanced along the upper surface of platform 28 toward end 20, frictional resistance between the hose and platform causes the tail end of the hose to drag behind, as shown. Frictional resistance between the hose H and platform 28 is enhanced by providing, on the platform 28, a layer of fabric material M, such as denim, having a high coefficient of resistance with respect to the hosiery material. The result is that the hose H is straightened for the subsequent seaming operation.

While pulling hose H, the arm 16 advances (see FIG. 2) to the end 20 of drive unit 14. Hose H is now positioned at a fixed location on platform 28, as shown in FIG. 2 (in dotted outlines).

During the next separating and stacking cycle, the arm 16 is moved toward end 22 at form 26 for grasping another hose from string S. The hose is grasped by the fingers 24 closing on the folded over portion of the next in-line hose H (this requires that the form 26 be manually indexed between the second and third positions). The hose is next pulled the length of the platform 28, which is at this point tilted downwardly (FIG. 2) by hydraulic cylinders 40 (only one of the cylinders is visible in the FIGURES) to transfer the hose H to the receiving receptacle. The cylinders 40 are connected between base 12 and each end of shaft 30 through links 42.

As aforementioned, form 26 containing the hosiery string S, is indexed between the second and third positions by the operator as he or she (by suction through open end 38 and manually) everts the first in-line hose (in the second position), and readies the drive unit 14 for cycling (in the third position). It sometimes occurs that the operator inadvertently moves form 26 from the third position back to the second position before arm 16 has reached end 20 of the drive unit 14. In order to prevent hose H from being moved laterally off platform 28, an upstanding guide member 44 is formed on platform 28. Guide member 44 is set off on an angle with respect to the platform, as shown, to retain the hose on the platform 28 without causing creasing.

Referring to FIG. 2, tray 15, located under the platform 28, contains an inclined side wall 46 adjacent platform 28. Side wall 46 is approximately in alignment with platform 28 in the downwardly tilted position to permit hose to slide down along the side wall for stacking. Also, since the stack of hose tends to lean against the inclined side wall 46, a large number of hose can be stacked in tray 15 without toppling over.

The specific mechanical apparatus by which the fingers 24 are operated whereby the hose is gripped, and the specific mechanical actuators for closing the fingers 24 and reciprocating the arm 16, does not form a part of the present invention, and, thus, has not been shown. Applicant hereby incorporates by reference the means shown in the two previous U.S. Pat. Nos. 3,887,120 and 3,949,913 that accomplish these movements. It is understood that this same means, or equivalent means, may be used in the present device without departure from the concept of the invention.

In this disclosure, there is shown and described only the preferred embodiment of the invention, but, as aforementioned, it is to be understood that the invention is capable of use in various other combinations and environments, and is capable of changes or modifications within the scope of the inventive concept as expressed herein.

What is claimed is:

1. An apparatus for separating, straightening, and stacking hose from a string, comprising:

a platform for supporting the separated hose;

means for separating hose and advancing the separated hose along a surface of said platform to a predetermined, fixed location on said platform, means for producing frictional resistance between said platform and hose during pulling serving to straighten said hose;

receiving means located below said platform for collecting and stacking hose; and means for transferring hose from said platform to said receiving means.

2. The apparatus of claim 1, wherein said transferring means includes means for tilting said platform from a first horizontal position to a second inclined position directed toward said receiving means.

3. The apparatus of claim 2, wherein is provided a tubular form, said string of hose being carried by said tubular form, said tubular form being movable between first and second positions, said platform being pivoted to the second inclined position toward said receiving means when said form is located in a predetermined one of said positions.

4. The apparatus of claim 2, wherein said receiving means includes a receptacle said receptacle including a sidewall inclined toward said platform, the hose sliding along said inclined sidewall to said receptacle during transferring.

5. The apparatus of claim 3, wherein said platform includes an upstanding guide member located adjacent said tubular form for preventing lateral movement of hose off said platform.

6. The apparatus of claim 3, wherein said pivoting means includes a pneumatic cylinder for pivoting said platform.

7. The apparatus of claim 1, wherein said separating means includes means for grasping an end portion of the first in-line hose and initial pulling said hose free of said string, said advancing means including a reciprocating arm for pulling the first in-line hose across said platform to said predetermined, fixed location on said platform.

8. The apparatus of claim 1, wherein said means for producing frictional resistance on the upper surface of said platform includes a layer of fabric material having a high coefficient of friction with respect to said hose for increasing drag on said hose during straightening.

9. The apparatus of claim 6, wherein said fabric material is denim.

10. In a hosiery handling apparatus for turning, separating, and stacking hose from a string, said apparatus being of a type including a tubular form for storing the hosiery string and everting said hose, and a reciprocating arm for separating a first in-line hose from said string and delivering said hose away from said form along a predetermined path, the improvement comprising:

a platform disposed in said predetermined path, said arm pulling the separated hose along a surface of said platform to a predetermined, fixed location on said platform, means for producing frictional resistance on said surface to provide drag and to straighten said hose;

a receptable located below said platform for receiving hose straightened on said platform; and means for transferring said straightened hose from said predetermined location on said platform to said receptacle for stacking.

11. The apparatus of claim 10, wherein is associated with said form means for turning said hose, and said transferring means comprising means for tilting said platform toward said receptacle.

12. The improvement of claim 11, wherein said tilting means includes a pneumatic cylinder for pivoting said platform.

13. A method of separating, straightening, and stacking hose with respect to a hosiery string containing a number of individual hose separated by a ring of break-away thread, comprising the steps of:

separating a first in-line hose by breaking its ring of break-away thread;

pulling the separated hose along a surface of a platform having a relatively high coefficient of friction, causing drag on said hose for straightening;

positioning the hose at a predetermined, fixed location on the platform; and stacking the straightened hose.

14. The method of claim 13 wherein said stacking step is performed by tilting the platform downwardly at an angle sufficiently large to overcome the coefficient of static friction between the hose and platform to allow the hose to fall by gravity into a free formed stack.

* * * * *